US007413056B2

(12) United States Patent
Gonzi et al.

(10) Patent No.: US 7,413,056 B2
(45) Date of Patent: Aug. 19, 2008

(54) LOAD LIFTING DEVICE

(75) Inventors: Mario Gonzi, Ponticino (IT); Fabrizio Gonzi, Ponticino (IT)

(73) Assignee: Comau S.p.A., Grugliasco (Turin) (IT)

( * ) Notice: Subject to any disclaimer, the term of this patent is extended or adjusted under 35 U.S.C. 154(b) by 0 days.

(21) Appl. No.: 11/169,047

(22) Filed: Jun. 28, 2005

(65) Prior Publication Data

US 2006/0169543 A1 Aug. 3, 2006

(30) Foreign Application Priority Data

Jun. 29, 2004 (IT) ..... FI2004A0149

(51) Int. Cl.
*B66B 9/02* (2006.01)
*B66F 3/22* (2006.01)

(52) U.S. Cl. ..... 187/269; 254/122

(58) Field of Classification Search ..... 187/269, 187/211; 254/122, 385

See application file for complete search history.

(56) References Cited

U.S. PATENT DOCUMENTS

| | | | | |
|---|---|---|---|---|
| 2,533,980 | A * | 12/1950 | Weaver | 254/9 B |
| 2,862,689 | A * | 12/1958 | Dalrymple et al. | 254/8 C |
| 2,928,558 | A * | 3/1960 | Bamford et al. | 414/680 |
| 3,246,876 | A * | 4/1966 | Larson | 254/122 |
| 3,785,462 | A * | 1/1974 | Coad et al. | 187/262 |
| 4,534,544 | A * | 8/1985 | Heide | 254/9 C |
| 5,054,578 | A * | 10/1991 | Smillie et al. | 182/69.4 |
| 5,395,209 | A * | 3/1995 | Busse et al. | 414/799 |
| 6,516,478 | B2 * | 2/2003 | Cook et al. | 5/611 |

FOREIGN PATENT DOCUMENTS

| | | | |
|---|---|---|---|
| EP | 0 839 757 | | 5/1998 |
| JP | 01301480 | A * | 12/1989 |
| JP | 10 218582 | | 8/1998 |
| JP | 2000238996 | | 9/2000 |
| JP | 2000238996 | A * | 9/2000 |

OTHER PUBLICATIONS

A copy of European Search Report dated Oct. 20, 2005.

* cited by examiner

*Primary Examiner*—Peter M. Cuomo
*Assistant Examiner*—Eric Pico
(74) *Attorney, Agent, or Firm*—Young Basile

(57) ABSTRACT

A load lifting device includes a lower structure, an upper structure movable with respect to the lower structure between a lowered position and a raised position, a scissors-like pantograph, including at least two arms mutually articulated according to an X-shape, connecting the upper structure to the lower structure, and an actuator device controlling the position of a connecting element which connects the actuator to one arm of the pantograph and having a cam-following element cooperating with a fixed cam. The actuator is articulated to the connecting element around an axis which is located below the articulation axis of the connecting element to the arm of the pantograph, in such a way that, when the actuator is activated to cause the lifting movement of the device, the connecting element acts as a pushing strut subjected substantially to compression between the cam and the articulated arm. Preferably the actuator includes a hoist device with a belt, cord, or chain engaging a number of pulleys.

20 Claims, 7 Drawing Sheets

LOAD LIFTING DEVICE

BACKGROUND OF THE INVENTION

The present invention relates to a lifting device of the type comprising:

a lower structure, an upper structure movable with respect to the lower structure between a lowered position and a raised position, a linkage connecting the upper structure to the lower structure and including at least one articulated arm, an actuator operatively interposed between the lower structure and the linkage, for controlling the movements of the upper structure between its lowered position and its raised position, a connecting element between the actuator and the linkage, said connecting element being articulated to said arm of the linkage and being provided with a cam-follower element cooperating with a fixed cam.

A device of the above indicated type is disclosed in JP 2000 238996.

The invention relates in particular to a lifting table with a pantograph linkage of the scissors-type.

As is known, pantograph-type lifting tables enable a movable frame (or platform) to be moved from the lowered position to the raised position while keeping it horizontal, even in case of an off-line mass. Basically, these pantograph-type lifting tables include a fixed base frame, with means for anchoring it to the floor, a movable frame for receiving the articles to be moved and four arms coupled to each other, in a scissors fashion, so as to provide a pantograph-type linkage, which is moved by suitable lifting means.

The lifting table device is shaped so as to occupy the volume of a parallelepiped defined by the two sides of the movable table, whereas its height varies from a minimum value, when the lifting table is closed (platform in the lowered position) up to a maximum value, when the table is opened (platform in its raised position). The pantograph-type lifting tables are particularly useful for automation of large manufacturing processes, also in case of heavy masses to be handled.

The lifting means may be of many types, depending upon the needs and the required forces; for instance, hydraulic cylinders, electric cylinders, or motor and reduction gear units with associated transmissions can be used.

Pantograph-type lifting tables are highly flexible and can be used both as lifting means, or as presses or as pushing devices. Lifting tables, however, have a huge drawback, which is implicit in their own way of operating. Indeed, due to the specific configuration of their linkage, at the beginning of the lifting phase, starting from the closed condition of the pantograph linkage, the vertical movement is hindered by a number of unfavorable leverages, so that the force required for lifting is much greater than the weight to be lifted and is variable throughout the entire movement. In particular, when the pantograph-type table is in its lowered (closed) position, if it has to be lifted by a lifting device operating under the table, during the first lifting step forces that are at least three or four times higher with respect to the actual weight to be moved vertically should be applied. It is evident therefore that there is an interest in developing a lifting device able to exploit all the potential advantages offered by the pantograph lifting tables, while overcoming the above mentioned drawback.

The above mentioned JP 2000 238996 solves the problem only partially, due to the provision of a fixed cam cooperating with a cam-following element carried by the above mentioned connecting element which connects the lifting device to the linkage. However, the arrangement shown in this document is not satisfactory, in particular because the above mentioned connecting element is subjected to a deflecting force during the lifting movement and therefore is not able to transmit the force applied by the actuator with a high efficiency.

SUMMARY OF THE INVENTION

The object of the present invention is that of providing a lifting device of the type indicated at the beginning of the present description which is able to overcome the above mentioned drawbacks of the prior art and which in particular is able to exploit the force applied by the actuator with a great efficiency in order to obtain the lifting movement of the device.

A further object of the invention is that of providing a device of the above indicated type which has a relatively simple structure.

In view of achieving these and further objects, the invention provides a lifting device having all the features which have been indicated at the beginning of the present description and further characterised that the above mentioned actuator is articulated to said connecting element around an axis which is always located below the axis of articulation between the connecting element and the articulated arm, in such a way that, when the actuator is activated to cause a lifting movement of the device, the said connecting element acts as a pushing strut subjected substantially to compression between the cam and said articulated arm of the linkage.

The structure and arrangement described in the foregoing actually solve the problem of transmitting the force applied by the actuator efficiently in order to obtain the lifting movement of the device.

In a preferred embodiment, said actuator is arranged so as to operate with a pulling action during lifting of the device, thus causing a raising movement of the cam-following element along the cam. However, a variant is not excluded in which the actuator is arranged to operate with a pushing action during lifting of the device.

Also in the case of the above mentioned preferred embodiment, the linkage of the device is a scissors-type pantograph, comprising at least two arms articulated to each other according to a X-shape, with two upper ends and two lower ends respectively connected to the upper structure and the lower structure, said upper ends and said lower ends being guided on said upper structure and said lower structure so that they are movable relative to each other along two parallel horizontal directions, the lower end of one of said arms being pivotally connected to the lower structure around a fixed axis.

Two pairs of articulated arms of the above described type are preferably used, which are parallel to each other and arranged side by side.

The above mentioned pushing strut has a head articulated to an arm of the pantograph and a foot pivotally connected to said actuator. Also in the case of the preferred embodiment, the cam-following element is a roller freely rotatably mounted on the pushing strut. Also preferably, the actuator is pivotally connected to the pushing strut around an axis coincident with, or adjacent to, the axis of the cam-following roller.

A further particularly preferred feature of the invention lies in that the cam cooperating with the cam-following element carried by said pushing strut has a cam surface configured with a profile such as to keep the force required from the actuator substantially constant during the entire lifting stage. This feature is particularly important in order to efficiently exploit the actuator. The actuator may be of any type, for example it can include an electric motor connected to a screw-and-nut system, preferably of the ball recirculation type, or a unit comprising an electric motor and a rack driven by the electric motor, or also a hydraulic cylinder. In the preferred embodiment, it is constituted by a hoist system of the type using a belt, a cord, or a chain.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 1:
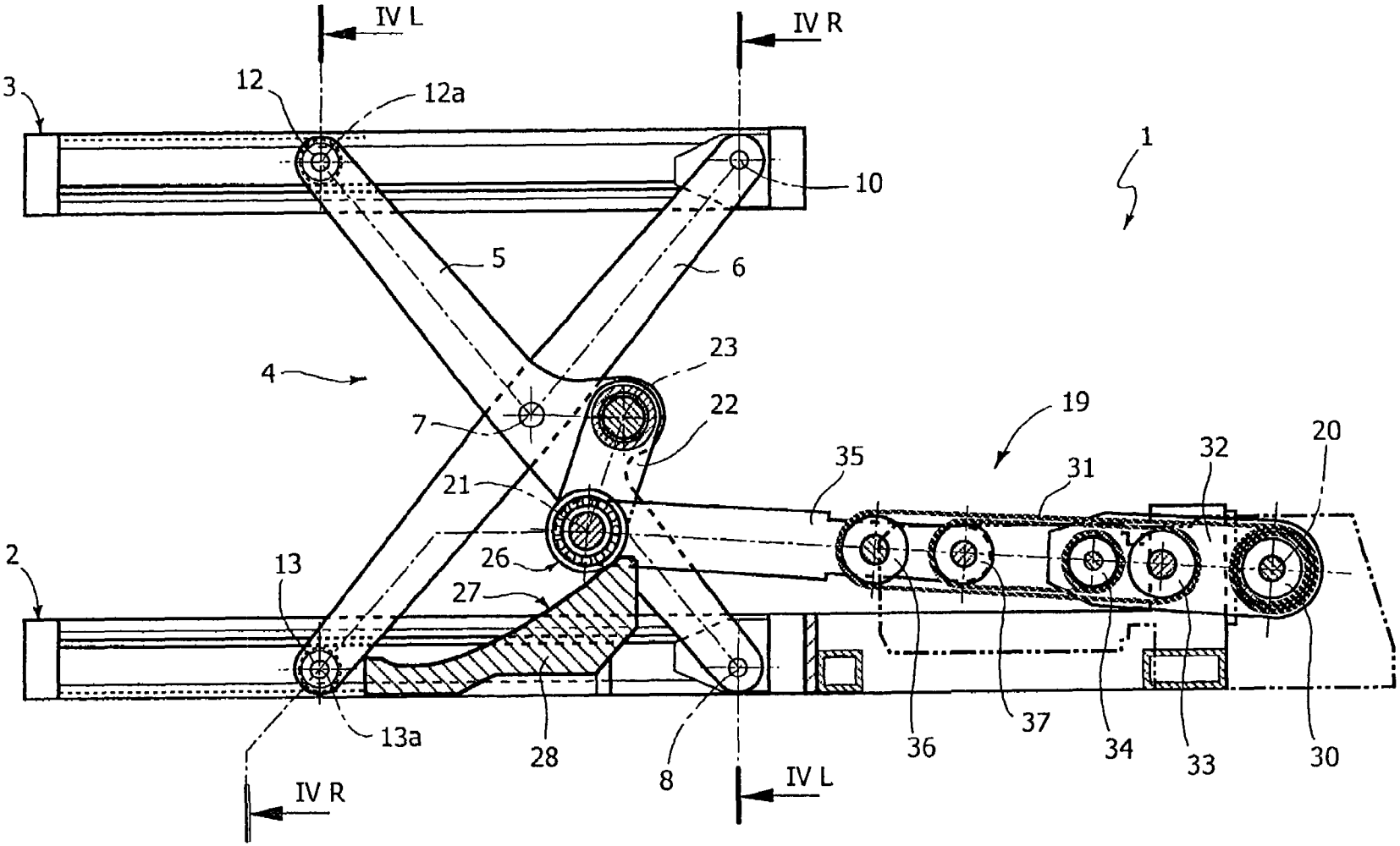
FIG. 1 is a side elevational view of a preferred embodiment of the lifting device according to the invention, shown in an opened condition (platform in the raised position)
Figure 2:
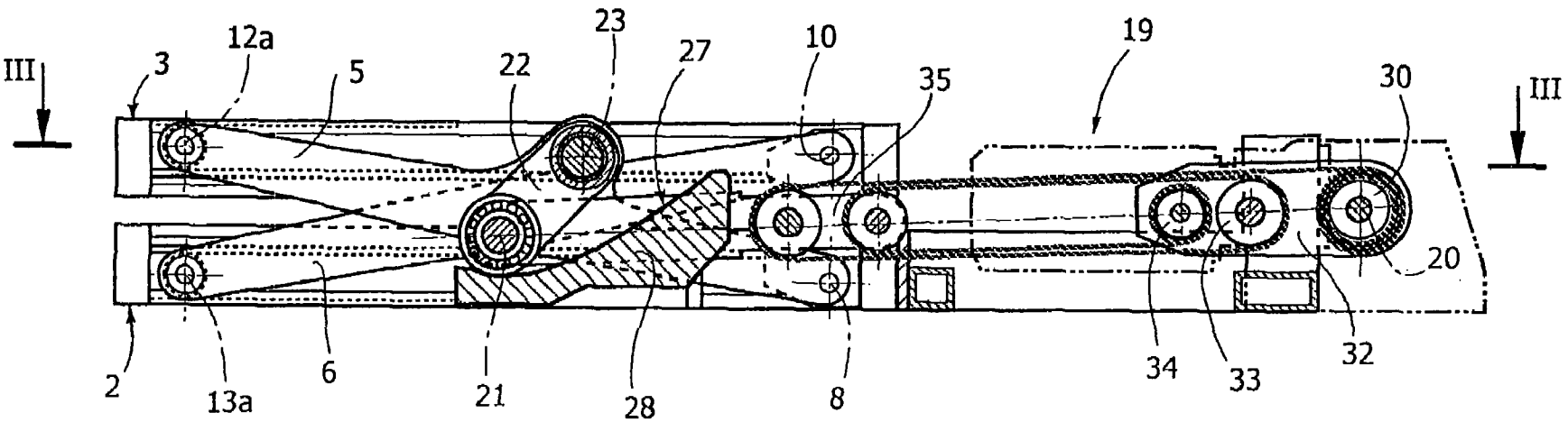
FIG. 2 shows a side elevational of view of the device of FIG. 1 in a closed condition (platform in the lowered position)

In the drawings, reference numeral 1 generally designates a lifting device of the type comprising a scissors-like linkage. Device 1 comprises a lower structure 2 and an upper structure 3 in form of a table or platform movable with respect to the lower structure 2 between a raised position, shown in FIG. 1, and a lowered position, shown in FIG. 2.

Table 3 is connected to the base structure 2 by means of a scissors-like linkage 4 which comprises two pairs of arms articulated to each other according to an X-shape and arranged in two vertical, parallel and spaced apart planes. Each pair of articulated arms comprises an arm 5 and an arm 6 articulated to each other around a horizontal axis 7. The arms 5 of the two pairs of articulated arms are arranged inside the two arms 6, as shown in FIG. 4.

Figure 4:
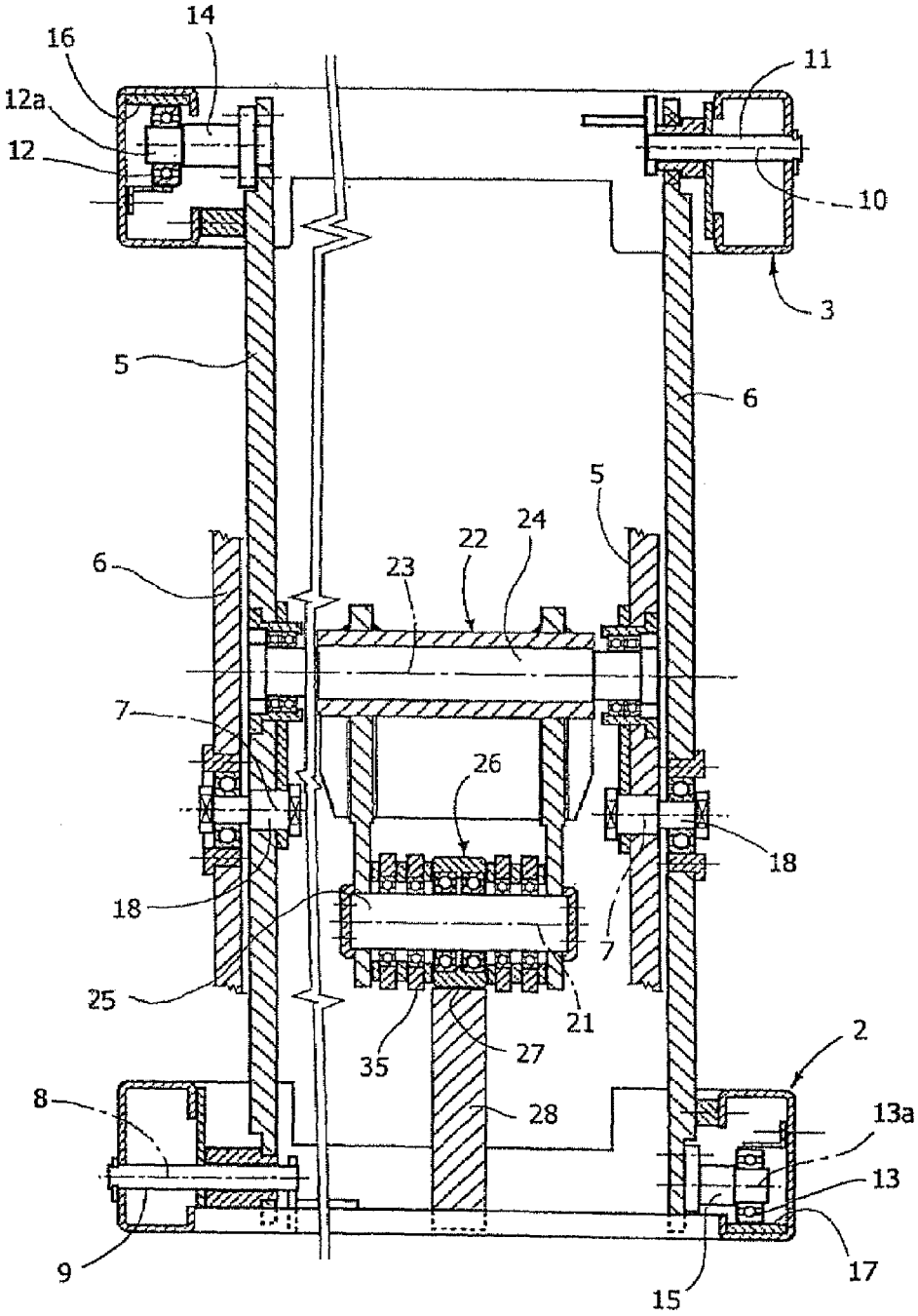
FIG. 4 is a front end view and in cross-section of the device of FIGS. 1-3, shown in an opened condition (platform in the raised position) along lines IV L and IV R of FIG. 1 (with reference to the left-hand part and the right-hand part of FIG. 4)

Each of the two inner arms 5 has one of its ends articulated to the base structure 2 around an axis 8 which is horizontal and parallel to axis 7, by means of an articulation pin 9, visible in the left lower part of FIG. 4. Each of the outer arms 6, on its turn, has one end articulated to the structure of the platform 3 around an axis 10 parallel to axes 7, 8, by means of an articulation pin 11 carried by the structure of table 3. Finally, the end of each inner arm 5 opposite to articulation 8 and the end of each outer arm 6 opposite to articulation 10 support rollers 12 and 13 (FIG. 4) freely rotatable on pins 14, 15 (having axes 12*a* and 13*a*) respectively fixed to the arm 5 and the arm 6 and are guided on cooperating tracks 16, 17 carried by the table 3 and the base structure 2. Due to this arrangement, the ends of arms 5, 6 connected to table 3 and the ends of arms 5, 6 connected to the base structure 2 are movable relative to each other along two parallel horizontal planes, so as to ensure that the horizontal arrangement of table 3 is maintained during the entire raising or lowering movement of the table.

In FIG. 4, there are also visible articulation pins 18 by which arms 5, 6 are mutually articulated around axis 7. All the above mentioned articulations preferably make use of roller or ball bearings.

The movement of linkage 4 between the lowered condition and the raised condition is controlled by an actuator unit generally designated by reference numeral 19.

As already specified in the foregoing, the actuator unit may be of any known type, but in the case of the preferred embodiment shown herein it comprises a hoist device with a belt engaged on pulleys.

The specific arrangement and the operation of the embodiment of the actuator 19 which is shown in the drawings will be described in detail in the following. For the time being, it will be sufficient to consider that the actuator unit 19 has one end pivotally mounted around an axis 20 parallel to axes 7, 8, 10 on the base structure 2 and the opposite end pivotally connected around an axis 21 to a connecting element 22 which connects the actuator unit 19 to the linkage 4. The connecting element 22 has one end articulated around an axis 23 parallel to axes 7, 8, 10 on the inner arms 5 of the two pairs of articulated arms of the linkage 4. In FIG. 4 there is visible the articulation pin 24 which is supported by the structure of the connecting element 22 and is rotatably mounted at its ends within the two inner arms 5. At the opposite end, the connecting element 22 has a fork shape, with a pair of brackets to which there is fixed a pin 25 on which a cam-following roller 26 is freely rotatably mounted. In the preferred embodiment shown herein, the axis of the cam-following roller is coincident with the articulation axis 21 of the actuator unit 19 on the connecting element 22.

The cam-following roller 26 cooperates with a cam surface 27 of a cam element 28 fixed to the base structure 2. The arrangement is such that the cam surface 27 causes a raising movement of the cam-following roller 26 when the distance between this roller 26 and the fixed axis 20 on which the actuator unit 19 is articulated is decreased, by activating the actuator unit 19.

As is shown, in any operating condition of the device, the axis 21 of articulation of the actuator unit 19 to the connecting element 22 is located below the axis 23 of articulation of the connecting element 22 to the inner arms 5.

Therefore, when the actuator unit 19 is shortened to cause a raising movement of the device, the cam-following roller 26 is compelled to raise along the cam surface 27 and the connecting element 22 acts as a pushing strut, undergoing substantially compression between the roller 26 and the articulation 23 to the articulated arm 5, so as to transform the pulling force applied by the actuator unit 19 into a force causing lifting of the device. Conversely, when the actuator unit 19 is elongated, the cam-following roller 26 goes down along the cam surface 27 and the device is lowered in a controlled way, the weight of the upper table 3 and the load which may be present thereon being transformed into a compression force acting on the connecting element 22, which again acts as a strut.

Also in the case of the preferred embodiment, the geometry of the cam surface 27 is predetermined so that the force which the actuator unit 19 must exert is substantially constant along the entire movement of the lifting device between its lowered position and its raised position.

Figure 3:
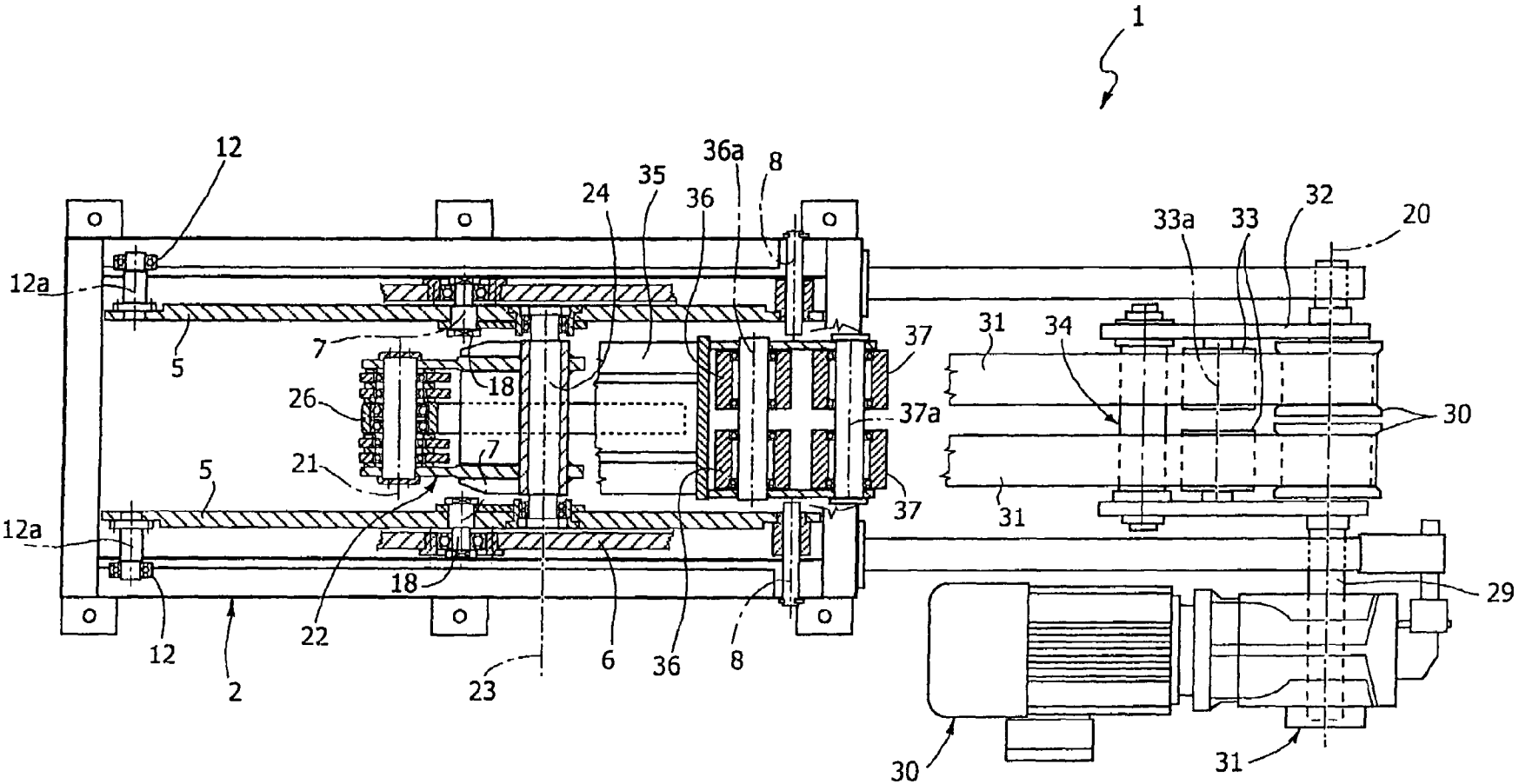
FIG. 3 is a plan view, in a cross section taken along line III-III of FIG. 2, of the device of FIGS. 1, 2.
Figure 5:
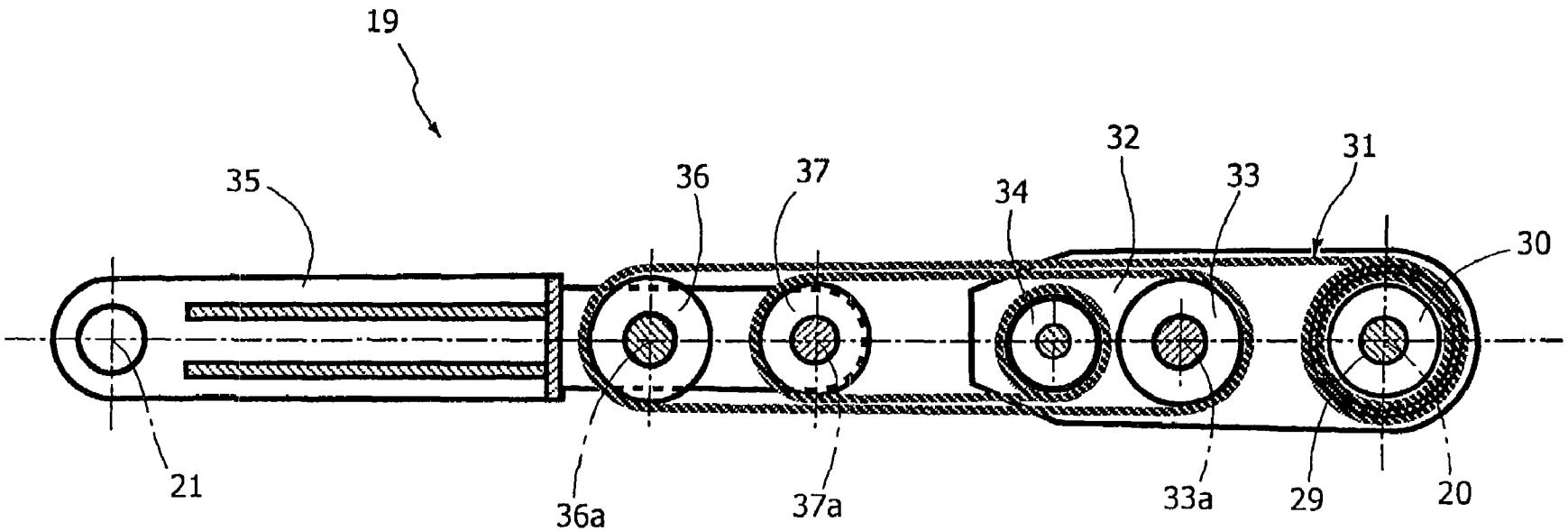
FIG. 5 is a side view at an enlarged scale of the actuating device forming part of the device according to the invention, FIG. 6 (A-B) shows an array of pantograph-type lifting devices, synchronised with each other, respectively in a side view and in a plan view, and FIG. 7 (A-B) shows a detail of a variant of the actuating device comprising a connecting-rod-and-crank linkage, in a side view and in a plan view.

With reference to the preferred embodiment of the actuator unit 19, which is visible particularly in FIGS. 3 and 5, the axis 20 of articulation of the actuator unit to the base structure 2 is defined by a shaft 29 (FIG. 3) which is rotatably supported by the base structure 2. The shaft 29 is rotated by an electric motor 30, by means of a transmission unit 31. In the specific case which is illustrated, the actuator unit is composed of two belt-type hoist devices which are identical and arranged side by side. Obviously the number of actuating systems which can be used may be any, as a function of the value of the masses to be moved.

In the illustrated example, on the shaft 29 there are fixedly mounted two drums 30 on each of which there is fixed one end of a belt 31. Each belt 31 is wound in more turns around the respective drum 30, which is arranged to receive the entire length of the belt 31 which is necessary for the entire lifting movement.

On the shaft 29 there is pivotally mounted a support structure 32 (FIG. 5) which supports a pair of freely rotatable pulleys 33 and a shaft 34 to which the two opposite ends of the two belts 31 are fixed. The actuator unit further comprises a second structure 35 independent from structure 32, which is pivotally mounted around axis 21 on the pin 25 carried by the connecting element 22. The structure 35 freely rotatably supports pairs of pulleys 36 and 37. The two structures 32, 35 pivotally mounted on the base structure 2 and the connecting element 22 are separated from each other but connected to each other and kept aligned with each other by the belts 31 which are wound in many turns around the pulleys 30, 36, 33 and 37 in the way which is described in the following. The flat belts 31, coining out tangentially from drums 30, are each wound by 180 degrees on pulley 36 which is freely rotatably mounted by rolling bearings on structure 35 around axis 36*a*. Each belt 31 is wound by 180 degrees on a pulley 33 which also is freely rotatably mounted by means of rolling bearings on a structure 32, around an axis 33*a*. Each belt 31 is then wound by 180 degrees on the respective pulley 36, which also is freely rotatably mounted by means of rolling bearings on structure 35, around an axis 37*a*. Finally, each belt 31 extends towards shaft 34 which acts as anchoring member for the belt end and as a belt take-up member, on which the belt is fixed by means of a pressure pad (not shown). The anchoring member 34 is a shaft to which one end of each belt 31 is anchored, this shaft being rotatable in order to put each belt under tension by winding the belt thereon. The rotation of shaft 34 can be driven by a torque wrench (not shown).

Starting from the lowered condition of table 3, a clockwise rotation (with reference to FIG. 5) of drums 30 causes winding thereon of the two belts 31, and as a result, a relative movement of the two end axes 20, 21 of the actuator unit 19 towards each other. During this stage, the tension imparted to the belts by winding thereof on drums 30 keeps the two structures 32, 35 constantly aligned with each other, whereas they are moved towards each other due to the tension of the belts. As already discussed, the shortening of the actuator unit 19 causes the raising movement of the cam-following roller 26 on the cam surface 27 and the resulting movement of linkage 4 towards the raised condition, due to the action of the connecting element 22 acting as a pushing strut. The use of many pulleys on which the belts are wound is equivalent to a conventional pulley lifting system which enables a reduction of the torque which must be imparted by the motor in order to cause lifting of a load. At the same time, as already illustrated, the cam surface 27 is preferably shaped so that the table and the mass thereon can be lifted through the application of a substantially constant torque by the motor.

In the lowering stage, it is the weight of the table 3 and the mass carried thereon which are discharged through the connecting element 22 on the cam-following roller 26, thus tending to cause an elongation of the actuator unit 19 which keeps the belts constantly in tension and maintains the two structures 32 and 35 of the actuator unit 19 aligned with each other.

Figure 6A:
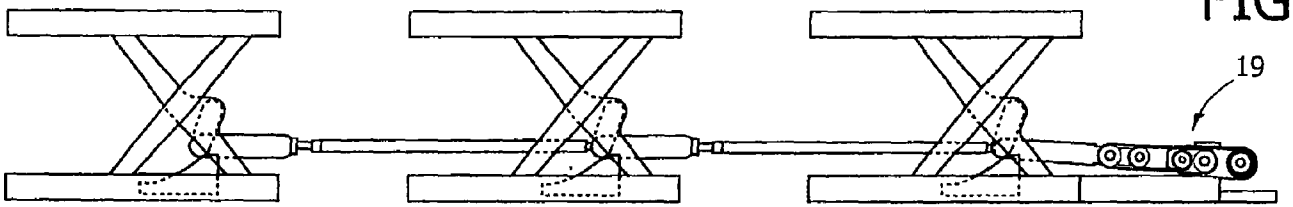
Figure 6B:
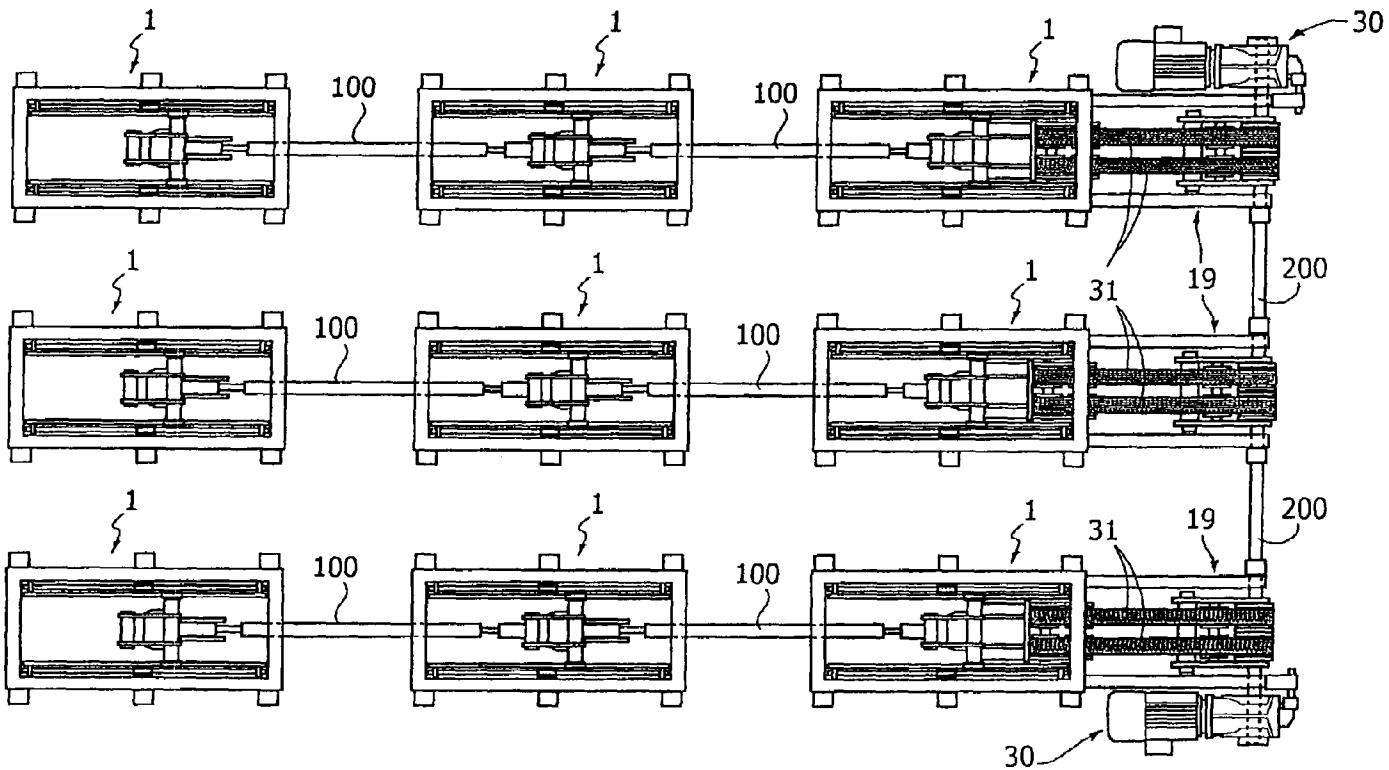

With reference to FIG. 6, the device according to the invention can be connected and synchronised with a plurality of similar devices through mechanical connections in series, as shown in FIG. 6. In the illustrated example, the synchronisation is achieved by connecting tie-rods 100 interposed between adjacent devices, so that only the device 1 at the beginning of each row of devices is provided with an actuator 19. Also the actuator units can have their shafts 29 mutually connected by shafts 200, so that only a single motor unit is needed on each side of the array of devices 1.

The various devices connected in the above described way may have, in groups, the upper table in common, in order to move large masses.

Figure 7A:
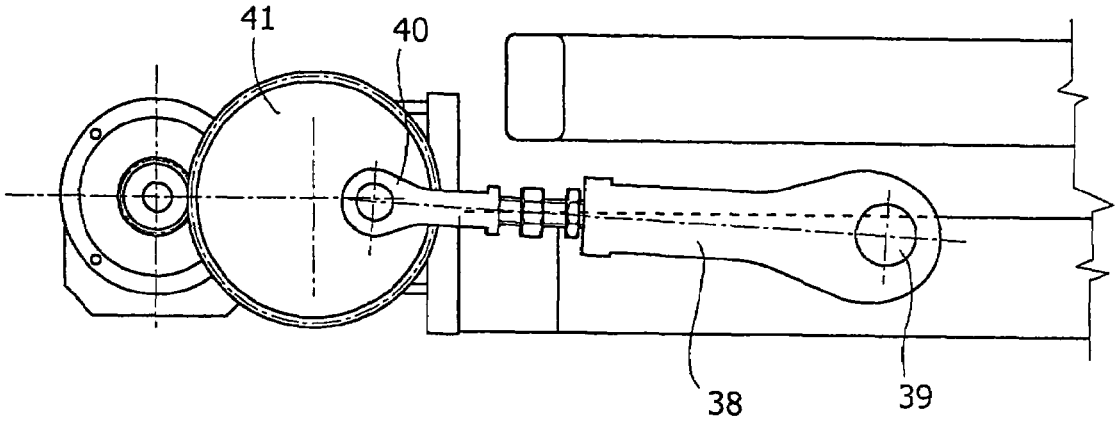
Figure 7B:
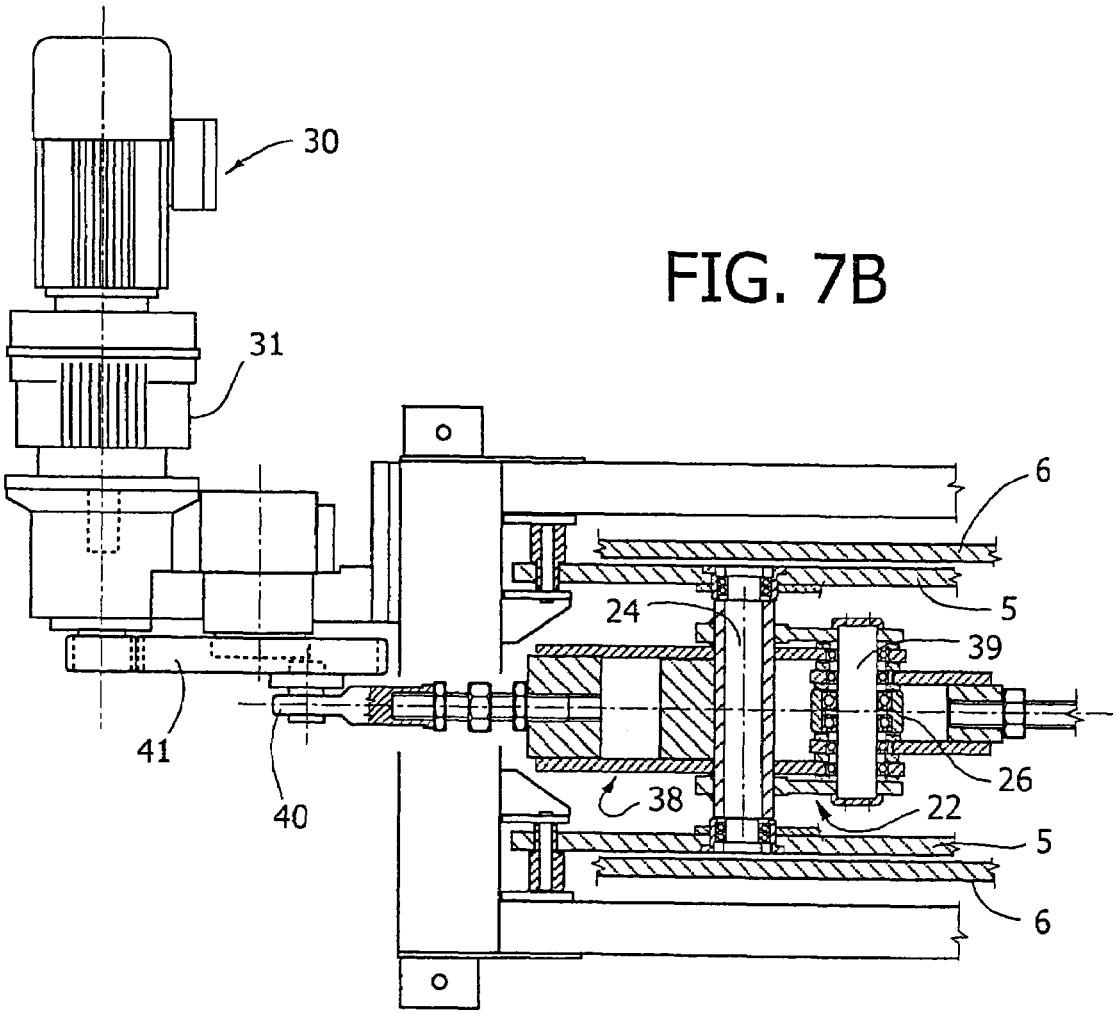

FIG. 7 shows a variant in which the actuator device is not in the form of a belt-type hoist as shown in FIG. 5, but rather comprises a linkage including a connecting rod 38 whose foot 39 is connected to the foot of the connecting element 22 and is therefore free to move along the profile of cam 28, whereas the head 40 of the connecting rod 38 is hinged, with the aid of a pair of rolling bearings, on an off-set pin of a toothed wheel 41 driven by the motor shaft. This solution, which is particularly indicated in the case of reduced displacements, and also for movements of sinusoidal type, has the advantage of having a very simple construction and therefore is particularly advantageous in setting up the device and also in its maintenance.

Furthermore, in the case of the solution of FIG. 7, the presence of two dead centres of the crank enables the two stop positions to be selected at said dead centres, so that the linkage can be actuated by the motor directly, with no need of an inverter, which is instead preferably used in the case of the previously described linkage. The connecting-rod-and-crank mechanism, along with the cam and the connecting element 22, provides for the possibility of driving many different types of movements, such as movements at constant speed, or with a triangular profile of the speed variation, or with a trapezoidal profile of the speed, etc.

As it is clearly apparent from the foregoing, the preferred embodiment of the invention has the advantage that the cam is shaped so as to insure that the effort required for the motor remains substantially constant during the entire movement of the linkage. This result enables the use of a lifting motor having the same size which would be used in case of a conventional lifting device with simple vertical movement, where no variation of the torque of the motor is required during the entire lifting movement.

Therefore, the device of the invention enables to drive the movement of the pantograph linkage in the same manner as is done in any lifting device with a simple vertical movement with a rack-and-pinion transmission or similar, thus ensuring the possibility of very high accelerations and/or speeds and the possibility to vary at will the acceleration and/or speed without implying the use of a lifting motor of larger size.

It is further to be noted that the above described lifting device can be easily adapted also to linkages which, in their closed position, are very low and flat and characterised by reduced transverse dimensions. It also provides for the possibility of a constant movement at each step of the raising or lowering stage and can be used to lift masses of any amount, with no limitation.

Naturally, while the principle of the invention remains the same, the details of construction and the embodiments may widely vary with respect to what has been described and illustrated purely by way of example, without departing from the scope of the present invention.

The example illustrated with reference to the drawings annexed hereto has an actuator unit 19 which operates with a pulling action in order to cause lifting of the device. This way of operation comes from that the cam surface 27 is facing towards the opposite side with respect to the articulated end 20 of the actuator unit 19. Obviously, if the articulated end 20 of the actuator unit is located on the left of cam 28, with reference to FIG. 1, the actuator unit should work with a pushing action in order to cause lifting of the device, the lifting movement corresponding to an elongation of the actuator unit.

What is claimed is:

1. Lifting device, comprising:

a lower structure, an upper structure movable with respect to the lower structure between a lowered position and a raised position, a linkage connecting the upper structure to the lower structure, and including at least one articulated arm, an actuator operatively interposed between the lower structure and the linkage, to drive the movement of the upper structure between its lowered position and its raised position, a connecting element between the actuator and the linkage, said connecting element being in form of an auxiliary arm having a first end articulated to said arm of the linkage for rotation with respect to a first articulation axis and a second end rotatably supporting a cam-following roller for rotation with respect to a second axis, said roller cooperating with a fixed cam, wherein the actuator is pivotally connected to said second end of the auxiliary arm for rotation with respect to said second axis, so that said second axis always remains located below said first articulation axis, wherein the actuator is a hoist device using a belt, cord or chain and including a number of pulleys on which said belt, cord, or chain is engaged, the hoist device including a plurality of hoist devices arranged side by side and operating in synchronism, whereby, when the actuator is activated to cause a lifting movement of the device, said auxiliary arm acts as a pushing strut subjected substantially only to compression stresses directed in the longitudinal direction of the auxiliary arm.

2. Device according to claim 1, wherein said actuator is arranged to operate with a pulling action during lifting of the device, by causing a raising movement of the cam-following element along the cam.

3. Device according to claim 2, wherein said linkage is a scissors-like pantograph, comprising at least two arms articulated to each other according to an X-shape with two upper ends and two lower ends respectively connected to the upper structure and the lower structure, said upper ends and said lower ends being guided on said upper structure and on said lower structure so that they are movable relative to each other along two parallel horizontal directions, the lower end of one of said arms being pivotally connected to the lower structure for rotation with respect to a fixed axis.

4. Device according to claim 3, wherein said pushing strut has a head articulated to one arm of the pantograph and a foot pivotally connected to said actuator.

5. Device according to claim 4, wherein said actuator is pivotally connected to said pushing strut for rotation with respect to an axis coincident with, or adjacent to, the axis of said cam-following roller.

6. Device according to claim 5, wherein the scissors-like pantograph comprises two pairs of arms articulated to each other according to an X-shape and in that said pushing strut is articulated to the inner arms by means of a central articulation pin.

7. Device according to claim 1, wherein said cam has a cam surface configured with a predetermined profile so as to keep the force which must be applied by the actuator substantially constant during the entire movement of the lifting device.

8. Device according to claim 7, wherein said pushing strut has a structure with a fork-shaped end including two brackets connected to each other by a pin on which said cam-following roller is freely rotatably mounted.

9. Device according to claim 1, wherein said hoist device comprises a first structure pivotally mounted for rotation with respect to a fixed axis on the lower structure, a second structure pivotally mounted on said pushing strut, a number of pulleys freely rotatably mounted on said first structure and said second structure and at least one belt, cord, or chain having one end connected to a winding drum carried by said first structure and engaged around at least one freely rotatable pulley carried by said second structure and at least one freely rotatable pulley carried by said first structure and having the opposite end anchored to a tensioning element carried by said first structure, said actuator further comprising motor means for driving the rotation of said winding drum.

10. A lifting device comprising:

a lower structure;

an upper structure movable with respect to the lower structure between a lowered position and a raised position;

a linkage connecting the upper structure to the lower structure, and including at least one articulated arm, wherein said linkage is a scissors-like pantograph including at least two arms articulated to each other according to an X-shape with two upper ends and two lower ends respectively connected to the upper structure and the lower structure, said upper ends and said lower ends being guided on said upper structure and on said lower structure so that the upper and lower ends are movable relative to each other along two parallel horizontal directions, the lower end of one of said arms being pivotally connected to the lower structure for rotation with respect to a fixed axis, wherein the scissors-like pantograph includes two pairs of arms articulated to each other according to an X-shape and in that said pushing strut is articulated to the inner arms by means of a central articulation pin;

an actuator operatively interposed between the lower structure and the linkage, to drive the movement of the upper structure between its lowered position and its raised position;

a connecting element between the actuator and the linkage, said connecting element being articulated to said arm of the linkage for rotation with respect to an articulation axis and being provided with a cam-following element cooperating with a fixed cam;

wherein the actuator is pivotally connected to said connecting element for rotation with respect to a pivot axis which is always located below the articulation axis between the connecting element and said articulated arm, in such a way that when the actuator is activated to cause a lifting movement of the device, said connecting element acts as a pushing strut subjected substantially to compression between the cam and said articulated arm, wherein said pushing strut has a head articulated to one arm of the pantograph and a foot pivotally connected to said actuator, wherein said actuator is pivotally connected to said pushing strut for rotation with respect to an axis coincident with, or adjacent to, the axis of said cam-following element, wherein said pushing strut has a structure with a fork-shaped end including two brackets connected to each other by a pin on which said cam-following element is freely rotatably mounted, wherein said actuator is arranged to operate with a pulling action during lifting of the device, by causing a raising movement of the cam-following element along the cam; and wherein said cam has a cam surface configured with a predetermined profile such that the force which must be applied by the actuator during the entire movement of the lifting device is substantially constant.

11. The lifting device of claim 10, wherein the actuator is selected from a group consisting of an electric motor connected to a screw-and-nut system, an electric motor and a rack driven by the electric motor, a hydraulic cylinder, a motor and reducing unit, a connecting-rod-and-crank mechanism, a hoist device using a belt, a hoist device using a cord, and a hoist device using a chain.

12. The lifting device of claim 10, wherein the actuator comprises a plurality of hoist devices arranged side by side and operating in synchronism.

13. The lifting device of claim 10, wherein the actuator includes a plurality of hoist devices arranged side by side and operating in synchronism, the plurality of hoist devices using at least one belt, cord or chain and including a number of pulleys on which the at least one belt, cord or chain is engaged.

14. The lifting device of claim 10, wherein the actuator comprises a hoist device using a belt, cord or chain and including a number of pulleys on which said belt, cord, or chain is engaged.

15. A lifting device comprising:

a lower structure;

an upper structure movable with respect to the lower structure between a lowered position and a raised position;

a linkage connecting the upper structure to the lower structure, and including at least one articulated arm;

an auxiliary connecting arm having a first end articulated to the arm of the linkage for rotation with respect to a first articulation axis and a second end rotatably supporting a cam-following roller for rotation with respect to a second axis, the roller cooperating with a fixed cam; and an actuator operatively interposed between the lower structure and the linkage, to drive the movement of the upper structure between the lowered position and the raised position, the auxiliary connecting arm located between the actuator and the linkage, the actuator pivotally connected to the second end of the auxiliary connecting arm for rotation with respect to the second axis, so that the second axis always remains located below the first articulation axis, such that when the actuator is activated to cause a lifting movement of the device, the auxiliary connecting arm acts as a pushing strut subjected to compression stresses directed in a longitudinal direction of the auxiliary connecting arm, wherein the actuator is arranged to operate with a pulling action during lifting of the device, by causing a raising movement of the cam-following element along the cam, the actuator pivotally connected to the pushing strut for rotation with respect to an axis coincident with, or adjacent to, the axis of the cam-following roller, the pushing strut having a structure with a fork-shaped end including two brackets connected to each other by a pin on which the cam-following roller is freely rotatably mounted, wherein the actuator includes a plurality of hoist devices arranged side by side and operating in synchronism, the plurality of hoist devices using at least one belt, cord or chain and including a number of pulleys on which the at least one belt, cord or chain is engaged.

16. The lifting device of claim 15, wherein the linkage is a scissors-like pantograph, comprising at least two arms articulated to each other according to an X-shape with two upper ends and two lower ends respectively connected to the upper structure and the lower structure, the upper ends and the lower ends being guided on the upper structure and on the lower structure so that the upper and lower ends are movable relative to each other along two parallel horizontal directions, the lower end of one of the arms being pivotally connected to the lower structure for rotation with respect to a fixed axis.

17. The lifting device of claim 16, wherein the pushing strut has a head articulated to one arm of the pantograph and a foot pivotally connected to the actuator.

18. The lifting device of claim 16, wherein the scissors-like pantograph comprises two pairs of arms articulated to each other according to an X-shape and in that said pushing strut is articulated to the inner arms by means of a central articulation pin.

19. The lifting device of claim 15, wherein the cam has a cam surface configured with a predetermined profile so as to keep the force which must be applied by the actuator substantially constant during the entire movement of the lifting device.

20. The lifting device of claim 15, wherein the actuator comprises a hoist device, the hoist device including a first structure pivotally mounted for rotation with respect to a fixed axis on the lower structure, a second structure pivotally mounted on the pushing strut, a number of pulleys freely rotatably mounted on the first structure and the second structure and at least one belt, cord or chain having one end connected to a winding drum carried by the first structure and engaged around at least one freely rotatable pulley carried by the second structure and at least one freely rotatable pulley carried by the first structure and having the opposite end anchored to a tensioning element carried by the first structure, the actuator further comprising motor means for driving the rotation of the winding drum.

* * * * *

UNITED STATES PATENT AND TRADEMARK OFFICE

CERTIFICATE OF CORRECTION

PATENT NO. : 7,413,056 B2
APPLICATION NO. : 11/169047
DATED : August 19, 2008
INVENTOR(S) : Mario Gonzi et al.

It is certified that error appears in the above-identified patent and that said Letters Patent is hereby corrected as shown below:

Column 5, Line 28; Delete “coining” and insert -- coming --, therefor.

Signed and Sealed this

Eleventh Day of November, 2008

JON W. DUDAS
*Director of the United States Patent and Trademark Office*